US005732452A

United States Patent [19]

Riedel, II

[11] Patent Number: 5,732,452

[45] Date of Patent: Mar. 31, 1998

[54] BURIAL URN WITH RESILIENT INNER LINER

[76] Inventor: Donald W. Riedel, II, 259 Georgia Ava., Valparaiso, Fla. 32580

[21] Appl. No.: 758,763

[22] Filed: Dec. 3, 1996

Related U.S. Application Data

[63] Continuation of Ser. No. 279,166, Jul. 22, 1994, abandoned.

[51] Int. Cl.[6] ..... A61G 17/08

[52] U.S. Cl. ..... 27/1; 52/128; 220/521

[58] Field of Search ..... 27/1, 26, 28; 52/128; 220/402, 408, 453, 484, 521

[56] References Cited

U.S. PATENT DOCUMENTS

| | | | |
|---|---|---|---|
| 1,940,771 | 12/1933 | Prier | 27/1 |
| 2,009,724 | 7/1935 | Bircher | 27/1 |
| 2,235,617 | 3/1941 | Klinzing | 27/1 |
| 2,385,520 | 9/1945 | Klinzing | 27/1 |
| 2,513,951 | 7/1950 | McClellen | 27/1 |
| 2,562,726 | 7/1951 | MacDonald et al. | 27/1 |
| 3,529,730 | 9/1970 | Thompson | 27/1 |
| 3,654,675 | 4/1972 | Peterson | 27/1 |
| 4,324,026 | 4/1982 | Craft | 27/1 |
| 4,607,417 | 8/1986 | Hancovsky . | |
| 4,635,814 | 1/1987 | Jones . | |
| 4,648,162 | 3/1987 | Daino . | |
| 4,877,203 | 10/1989 | Harden . | |
| 5,029,373 | 7/1991 | Raymond | 27/1 |
| 5,156,295 | 10/1992 | Gordon et al. . | |
| 5,379,499 | 1/1995 | Jackson | 27/1 |

*Primary Examiner*—Carl D. Friedman
*Assistant Examiner*—Beth A. Aubrey
*Attorney, Agent, or Firm*—Cushman Darby & Cushman IP Group of Pillsbury Madison & Sutro, LLP

[57] ABSTRACT

A dual-layer burial urn comprising a hollow outer decorative casing surrounding an inner resilient liner formed of a high-impact plastic. The outer casing is formed from a base resin, such as an acrylic or polymeric material and inert fillers. The outer surface contains an opening at one end of its body, with a recess surrounding the opening. The inner liner has a screw-threaded aperture aligned with the opening and the recess. An inner plastic top having a screw-threaded portion for engaging the aperture of the inner liner is provided for sealing the inner liner.

14 Claims, 4 Drawing Sheets

BURIAL URN WITH RESILIENT INNER LINER

This is a continuation of application Ser. No. 08/279,166, filed on Jul. 22, 1994, which was abandoned upon the filing hereof now abandoned.

BACKGROUND OF THE INVENTION

1. Field of Invention

The present invention relates generally to a burial urn and a method for making the same. The burial urn is formed by an inner liner comprising a high-impact plastic and an outer decorative casing comprising acrylic or polymeric material of high-impact strength.

2. Description of Related Art

Burial urns are extensively used for encasing the remains of cremated bodies. Such urns are typically either retained in mausoleums or interred in the ground. In the past, a variety of devices have served as burial urns.

Several attributes and characteristics are typically desired from burial urns. The first desirable attribute is the presence of an outer surface which provides an aesthetically pleasing appearance, thereby making the burial urn suitable for religious ceremonies that frequently accompany the passing of the deceased. Second, the burial urn preferably is constructed in such a manner so as to effectively protect the urn's contents from external forces that are often imparted thereon. For example, when interred in the ground, the burial urn must be capable of withstanding deterioration and erosion that can be caused by moisture. In addition, when retained in mausoleums or other locations, it is desirable that the burial urn be impervious to rupture in case the urn is accidentally struck or dropped.

The construction of a burial urn that provides both the monolithic design that is associated with traditional customs and the resiliency to withstand the physical demands of internment or prolonged display is unknown in the prior art.

The problems encountered in the prior art are two-fold. First, conventional burial urns are typically assembled by using glues, adhesives, and sealers. Such a construction generally produces a burial urn that possesses a weak integrity and insufficient durability. Second, conventional urns are constructed from materials that do not exhibit an appropriate combination of both strength and attractiveness. For example, metal urns supply an aesthetically appealing appearance, but are susceptible both to corrosion and rust and to rupture when dropped or struck. Similarly, wood urns tend to deteriorate and rot with the passage of time. Stone and porcelain urns will shatter if subjected to an excessive external force. Glass urns, such as that disclosed in U.S. Pat. No. 4,648,162 issued to Daino, also provide an aesthetic quality but fail to exhibit the desired strength to withstand physical stress. Structural failure which is often encountered in each of the above-mentioned constructions, can result in cremains leaking from the urns. Moreover, the above-mentioned urns tend to be expensive.

In an effort to resolve these problems, burial urns constructed from thermosetting material have been proposed. For example, U.S. Pat. No. 2,562,726 issued to MacDonald et al. discloses a burial urn that includes an outer body formed of a hardenable plastic outer composite and an inner lining formed of glass. U.S. Pat. No. 3,654,675 issued to Peterson disclosed a rigid burial urn constructed of a thermosetting material. U.S. Pat. No. 4,607,417 issued to Hancovsky discloses an urn-like canister that is molded from plastic material. However, none of the urns disclosed in these patents possesses the aesthetically pleasing outer appearance which adheres to the traditions and customs of burial.

SUMMARY OF THE INVENTION

It is therefore an object of the present invention to provide a burial urn that provides an aesthetically pleasing outer appearance while not being adversely affected by external forces acting on the urn, such as moisture and physical stress.

It is another object of the present invention to provide a burial urn that is formed from an inner liner comprising a high-impact plastic so as to protect the cremation remains inside the liner, and an outer casing comprising a densified acrylic or polymeric material and inert filler so as to provide a decorative outer appearance.

It is still another object of the present invention to provide a burial urn with a hermetically sealed lining so as to keep the cremation remains safely intact inside the lining and thus prevent spillage.

It is a further object of the present invention to provide a burial urn constructed from an inexpensive material.

It is still a further object of the present invention to provide a method for making a burial urn that provides an aesthetically pleasing outer appearance while not being adversely affected by external forces acting on the urn, such as moisture and physical stress.

It is still a further object of the present invention to provide a one-piece outer shell that is molded in a single piece during manufacture, as opposed to a multi-piece outer shell whose parts must be glued or fastened together.

These and other objects, features and advantages of the present invention will become apparent from the following detailed description when taken in conjunction with the accompanying drawings which illustrate, by way of example, the principles of the invention.

BRIEF DESCRIPTION OF THE DRAWING

The accompanying drawings illustrate the invention. In such drawings.

DESCRIPTION OF THE PREFERRED EMBODIMENTS

Figure 1:
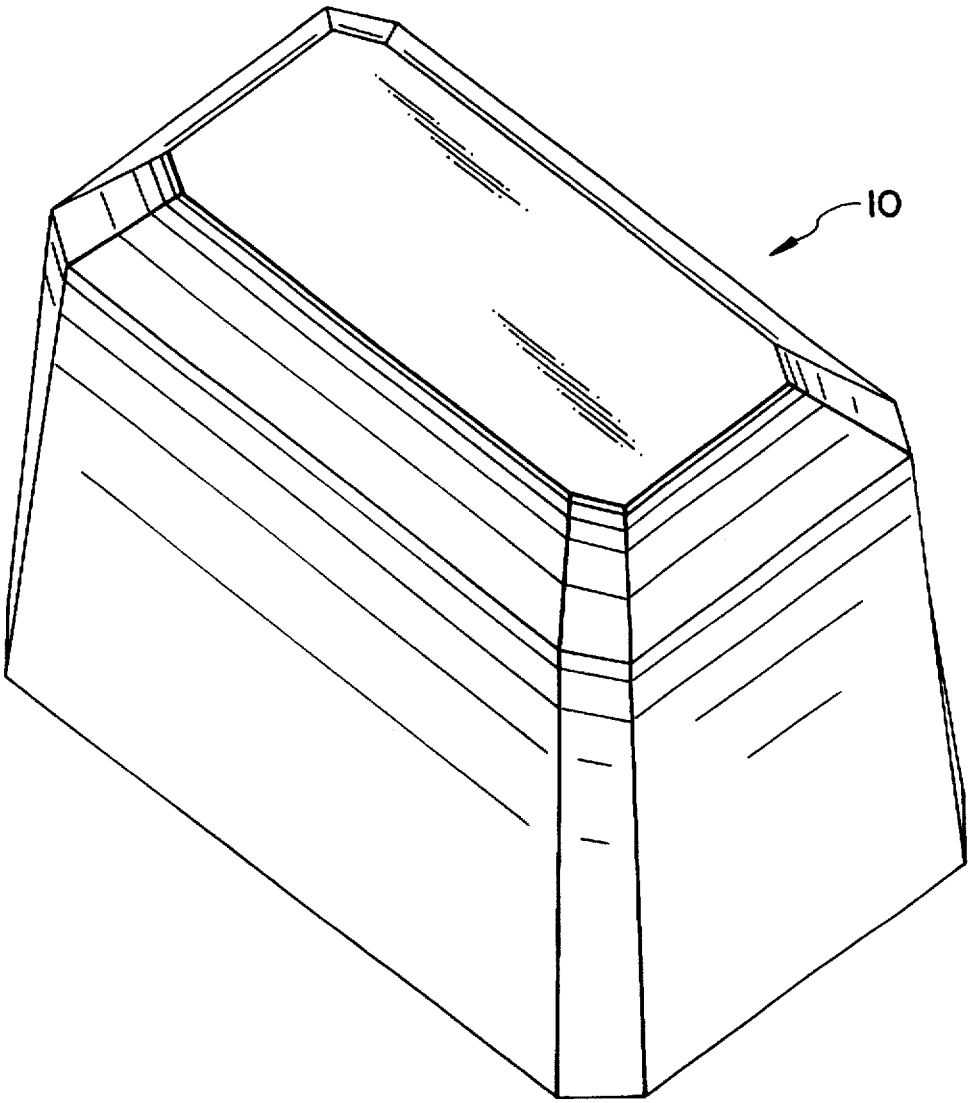
FIG. 1 is a perspective view of a preferred embodiment of the burial container as encompassed by the present invention.

A detailed description of the present invention is provided below.

As shown in the accompanying drawings, a preferred embodiment of a burial urn containing a resilient inner liner and a decorative outer casing in accordance with the present invention is designated generally by the reference numeral 10.

Figure 2:
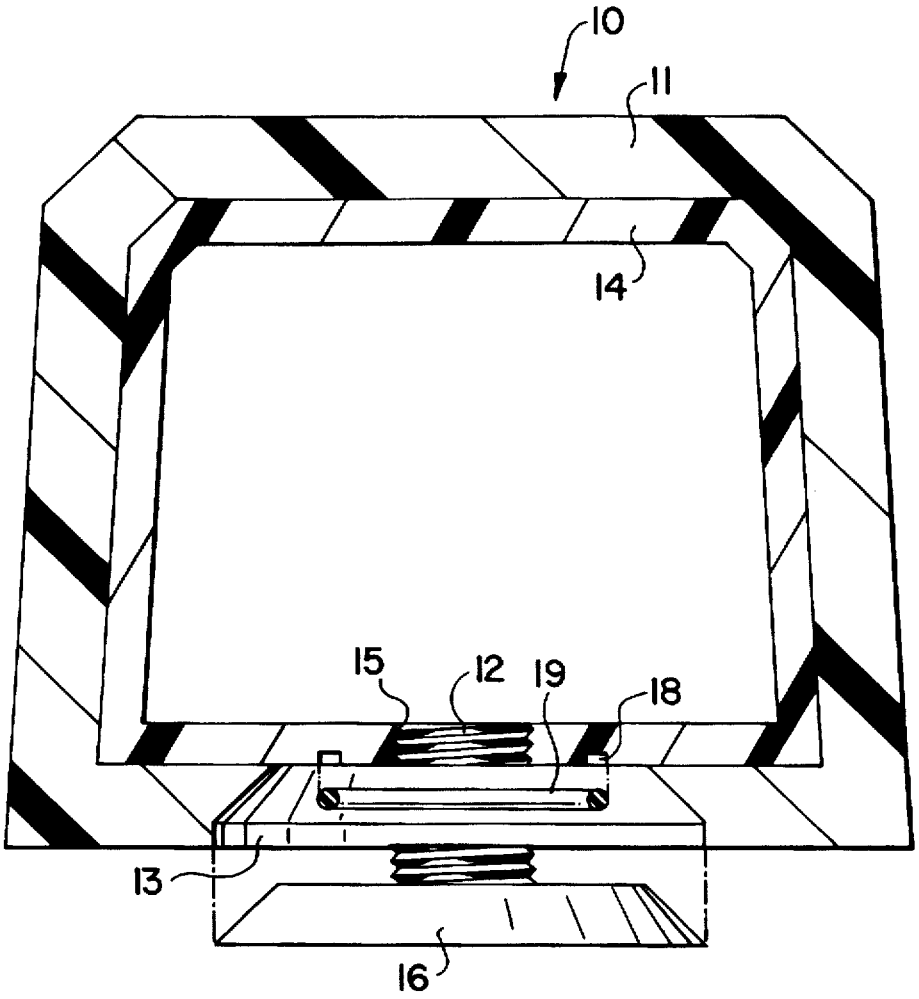
FIG. 2 is a front cross-sectional view of the burial container as encompassed by the present invention.

As shown in FIGS. 1 and 2, a burial urn 10 as constructed in accordance with the present invention comprises an outer casing 11, generally possessing a hollow container-type shape with a substantially uniform thickness. The outer casing 11 contains an opening 12 at one end of its body. A recess 13 is located on the outer surface of the outer casing 11 and surrounds the opening 12. The opening 12 is preferably located at the bottom end of the outer casing 11 so as to conceal it from view during display of the burial urn 10. The recess 13 preferably possesses an annular shape.

The outer casing 11 is molded in such a manner so as to surround and permanently encase an inner liner 14. The inner liner 14 includes a screw-threaded aperture 15, which is arranged so as to align with the opening 12 and the recess 13 of the outer casing 11. An inner plug 16 having a screw-threaded portion is provided for engaging the screw-threaded aperture 15 of the inner liner 14 in such a manner so as to hermetically seal the inner liner 14.

The engagement between the inner plug 16 and the screw-threaded aperture 15 may be further augmented by the addition of O-ring groove 18 and an O-ring 19. The O-ring groove 18 is positioned on the outer surface of the inner liner 14, forming an annular-shaped channel around the screw-threaded aperture 15. The width of the O-ring groove 18 is sized so as to securely receive the O-ring 19. The O-ring 19 acts to more thoroughly seal the inner plug 16 to the screw-threaded aperture 15, thereby further preventing spillage of the cremains.

The outer casing 11 is formed from a matrix comprising a base resin and an inert filler. The base resin preferably is a densified acrylic or polymeric material which includes, but are not limited to, an isothalic neo-pentylglycol modified unsaturated polyester resin with a styrene monomer or a mixture of a styrene monomer and methyl methacrylate. The base resin is promoted to a cure with methyl ethyl ketone peroxide or benzoyl peroxide at room temperature. Furthermore, the inert filler preferred for use in the present invention includes, but is not limited to, aluminum trihydrate, pigments, or calcium carbonate. The matrix preferably comprises, but is not limited to, a combination of 25%–50% base resin and 50–70% inert filler. Selection of the proper inert filler is dependent upon the appearance desired for the outer casing 11.

The term "densified" is used to refer to a base resin possessing an absence of a significant amount of air bubbles. Such a densified base resin is formed by mixing and homogenizing the base resin and inert filler in a vacuum chamber (not shown).

Because it is made from densified acrylic or polymeric material, the outer casing 11 also is sufficiently durable to withstand the external forces, impacts, pressures, and deterioration that commonly occur during interment. Furthermore, the resilient matrix which forms the outer casing 11 can withstand such external pressures as impact, stains, and fire, which are commonly encountered when the burial urn 10 is not interred.

The inert filler functions to provide the outer casing 11 with a traditional stone/granite appearance that is inherent to the traditions and customs of burial. For example, as with traditional customs, the deceased's name, life span, and other information can be directly engraved in outer casing 11 with standard tools, eliminating the need for additional metal or plastic plaques. In addition, the combination of the inert filler with the acrylic or polymeric material—i.e., the matrix—imparts additional strength to the outer casing 11. As explained above, the outer casing 11 is such that weather extremes will not cause cracking or drying as typified in wood burial urns, or rust or corrosion as experienced in metal burial urns.

The inner liner 14 of the burial urn 10 is formed from a high-impact plastic. The high-impact plastic may include for example, but is not limited to, polyethylene or ABS (i.e., acrylonitrile-butadiene-styrene). The high-impact plastic is resilient so as to withstand external pressures that may result in breakage or rupture of the inner liner 14. Moreover, the plastic is not susceptible to deterioration.

The inner liner 14 may be originally cast in one piece or a plurality of pieces (preferably no more than two). If cast in a plurality of pieces, the pieces are permanently joined by PVC (i.e., polyvinyl chloride) cement or styrene solvent to form the inner liner 14. The inner liner 14 is of a sufficient thickness to withstand the rigors encountered during the casting of the outer casing 11. The thickness of the inner liner 14 is at least 1/16 inch, but not more than 1/4 inch, with a preferable range between 1/16 and 1/8 of an inch. A lesser thickness is undesirable since its integrity could not withstand the pressure and heat asserted from the matrix during the molding of the outer casing 11 (see below). Moreover, increasing the thickness of the inner liner 14 will cause a corresponding decrease in the volume within the inner liner 14. In order to assure sufficient capacity for complete interment of even the largest adult individuals, the volume inside the inner liner 14 should exceed 300 cubic inches. A smaller size may be used to accommodate children, infants, or animals. In addition, the inner liner 14 is preferably formed with rounded corners for relieving stress points during manufacture of the outer casing 11.

The inner plug 16 is constructed and arranged to hermetically seal the screw-threaded aperture 15 of the inner liner 14. As explained above, the inner plug 16 preferably contains a screw-threaded portion for engaging the screw-threaded aperture 15 of the inner liner 14. The screw-type arrangement provides a lasting seal for the inner liner 14, while also allowing for subsequent opening of the inner liner 14 if transfer or some other reason makes the opening of the inner liner 14 necessary. However, the present invention is not limited to a screw-type seal. Instead, other devices may be used in the scope of the present invention in order to engage the inner plug 16 to the inner liner 14. Alternative devices that may be used to seal the inner liner 14 and inner plug 16 include, but are not limited to, standard caps, flush plugs, and overlap plugs.

The inner plug 16 is comprised of a high-impact plastic similar to that of the inner liner 14. The high-impact plastic may include for example, but is not limited to, polyethylene or ABS. The inner liner 14 and the inner plug 16 are preferably formed from the same material, although different materials may be used. The high-impact plastic is resilient so as to withstand external pressures that may result in breakage or rupturing of the inner liner 14. Moreover, the selected material must be resistant to deterioration that accompanies the passage of time.

The opening 12 and aperture 15 are of a sufficient diameter to allow for easy filling of the burial urn 10. Preferably, the diameters are at least 2 inches.

A detailed description illustrating a method for producing a burial urn in accordance with the present invention is herein provided. The inner liner 14 is formed of a high-impact plastic and may be cast in one piece or a plurality of pieces (preferably no more than two). If cast in more than one piece, the pieces are permanently joined to form the inner liner 14. The thickness of the inner liner 14 is at least 1/16 inch, but not more than 1/4 inch, with a preferable range between 1/16 inch and 1/8 inch. In addition, inner liner 14 is preferably formed with rounded corners for relieving stress points and maintaining the integrity of the inner liner 14 during molding of the outer casing 11.

Figure 3:
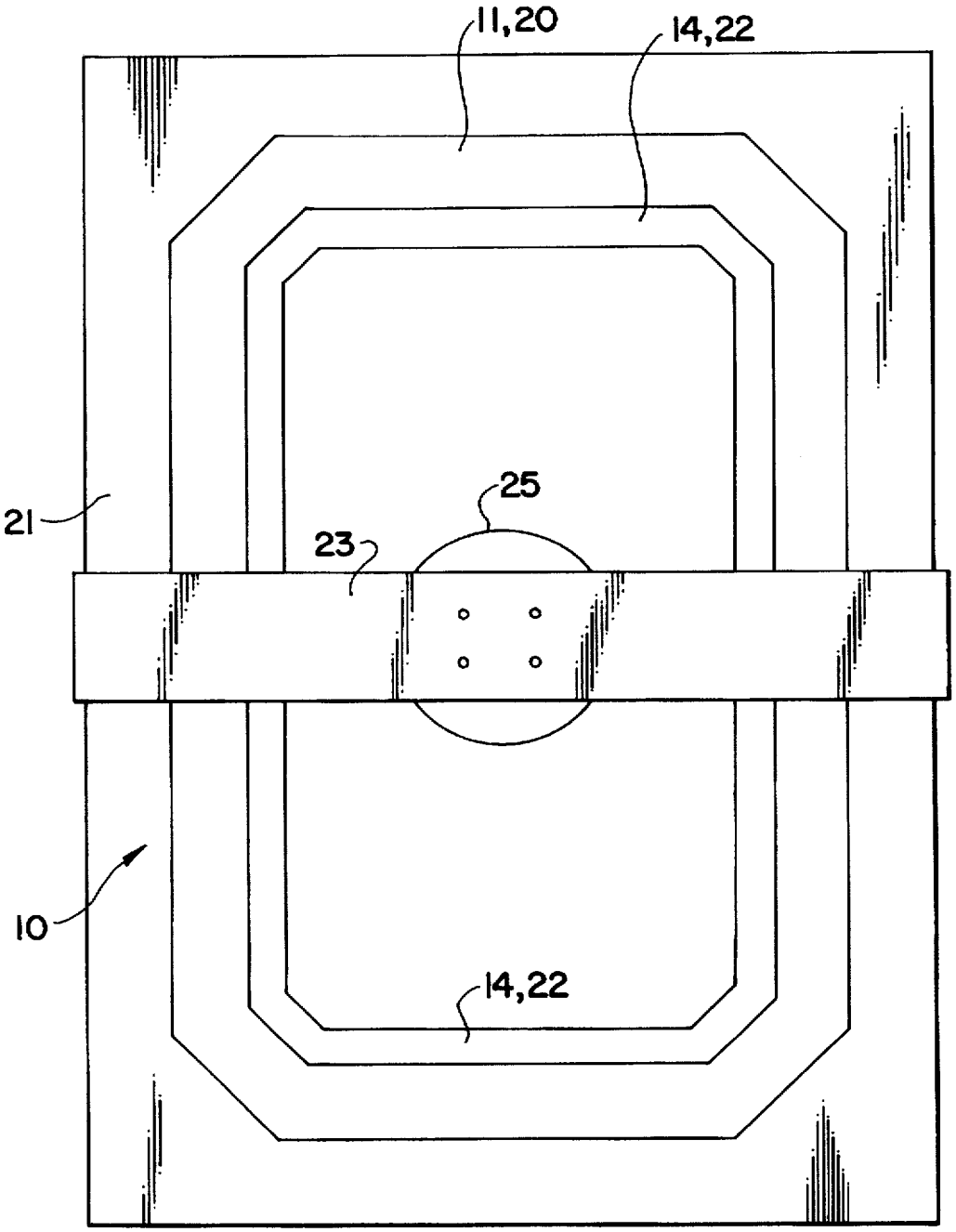
FIG. 3 is an over-head view of the method for making a burial container according to the present invention.
Figure 4:
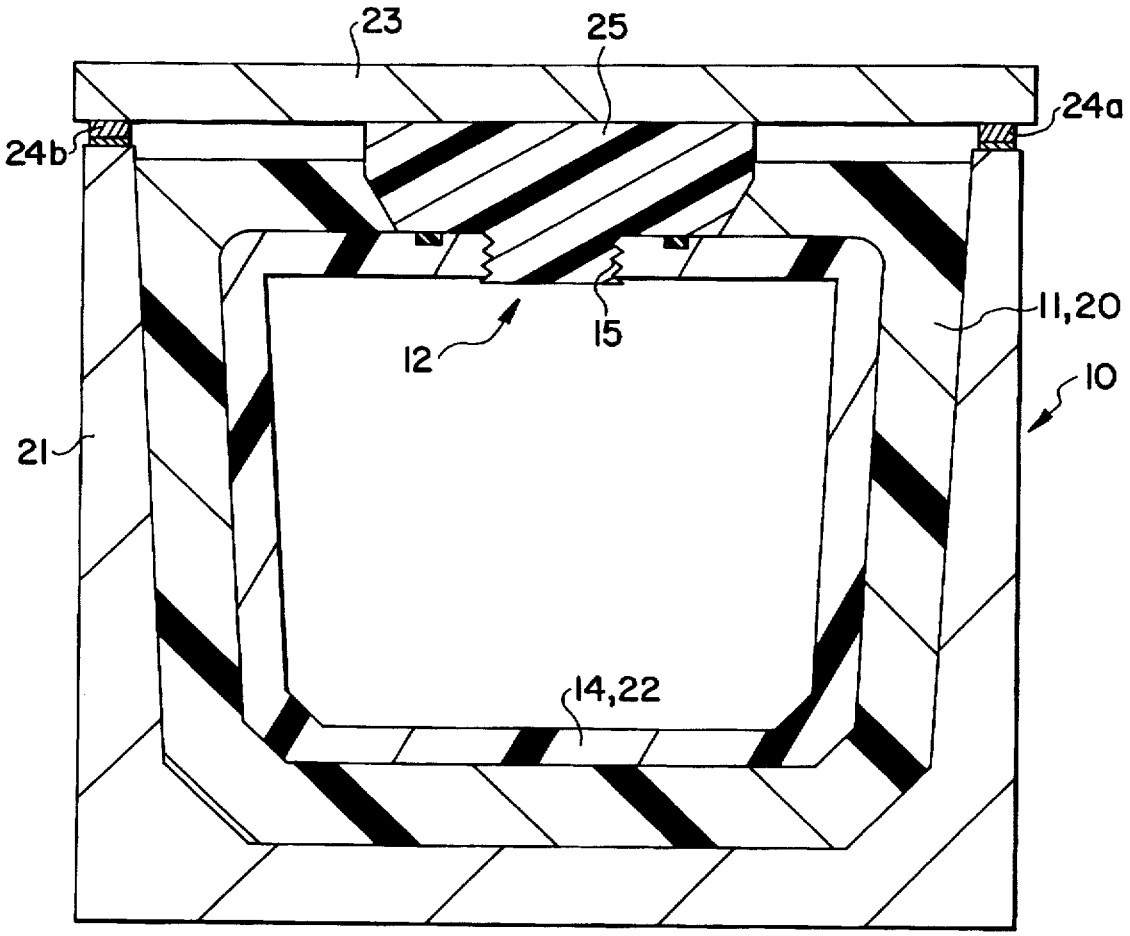
FIG. 4 is a front cross-sectional view of the method for making a burial container according to the present invention.

As shown in FIGS. 3 and 4, the outer casing 21 is molded while the burial urn 10 is positioned in an inverted position. After the inner liner 14 is formed, it is placed within an outer mold-half 21 to form a mold cavity 20. The inner liner 14 functions as an inner mold-half 22 of the mold cavity 20. The distance between the inner liner 14 and the outer mold half 21 is substantially uniform so as to form a mold cavity 20 of a substantially uniform thickness. The outer casing 11 is molded within the mold cavity 20.

A support bar 23 is positioned over the mold cavity 20 during the molding process. Spacers 24*a* and 24*b* are inserted intermediate the ends of the support bar 23 and the top of the outer mold half 21. The spacers 24*a* and 24*b* elevates the support bar 23 above the mold cavity 20, thereby preventing the support bar 23 and the outer mold half 21 from coming into direct contact.

A circular screw-face attachment 25 is attached to the lower face of the support bar 23 by screws or other connecting means. The circular screw-face attachment 25 is positioned relative to the support bar 23 so that the center of the circular screw-face attachment 25 is aligned with the center of the support bar 23.

As explained above, the inner liner 14 forms the inner mold half 22 of the mold cavity 20. The inner liner 14 is supported in its desired position by engaging the screw-threaded aperture 15 of the inner liner 14 with the circular screw-face attachment 25. Thus, inner liner 14 is suspended from above by the circular screw-face attachment 25. The burial urn 10 is molded in an inverted position to allow suspension of the inner liner 14 from the circular screw-face attachment 25.

The screw-face attachment 25 is constructed and arranged so as to effectively function as part of the upper portion of the outer mold half 21. That is, the screw-face attachment 25 forms the recess 13 and opening 12 of the outer casing 11 and the screw-threaded aperture 15 of the inner liner 14. The dimensions of the screw-threaded attachment 25 determine the configurations of the opening, recess 13, and aperture 15.

As shown in FIG. 4, the screw-threaded attachment 25 tapers along an inward direction at opening 12 in order to facilitate the ease of releasing the molded burial urn 10 therefrom and to prevent stress from being imparted to the outer casing 11 during demolding. The upper portion of the screw-threaded attachment 25 (but not the screw-threaded portion thereof) may be pre-coated with releasing agent in order to further facilitate its separation from the outer casing 11 after molding is complete. In addition, the demolding process is further assisted by pre-coating the outer mold half 21 with a conventional releasing agent. However, no releasing agents are coated on the inner liner 14, since adhesion between the inner liner 14 and the outer casing 11 provides a desirable increase in strength of the burial urn 10. Moreover, in order to ensure that the inner liner 14 is adequately supported, no releasing agents are coated on the screw-threaded aperture 15 or the screw-threaded portion of the screw-threaded attachment 25 that is engaged thereto.

The type of releasing agent employed depends upon the nature of the mold. For instance, where the mold cavity 20 is formed from metal, the releasing agents may include, but are not limited to, conventional high temperature mold release waxes. Where the mold cavity 20 is formed from plastic, the releasing agents may include, but are not limited to, PVA (i.e., polyvinyl acetate).

The outer casing 11 is formed from a matrix comprising a base resin and an inert filler. The base resin preferably used in the present invention is a densified acrylic or polymeric material which may include, but are not limited to, an isothalic neo-pentylglycol modified unsaturated polyester resin with a styrene monomer or a mixture of a styrene monomer and methyl methacrylate. The base resin is promoted to a cure with methyl ethyl ketone peroxide or benzoyl peroxide at room temperature. Furthermore, the inert filler preferred for use in the present invention includes, but is not limited to, aluminum trihydrate, pigments, or calcium carbonate. The matrix preferably comprises, but is not limited to, a combination of 25%–50% base resin and 50–70% inert filler.

The matrix is formed by mixing and homogenizing the base resin and inert filler in a vacuum chamber (not shown). The vacuum chamber acts to prevent the formation of and encourage the removal of air bubbles in the matrix. The absence of air bubbles within the matrix provides a stronger, densified outer casing 11. The vacuum step provides a solid surface material by removing porosity and moisture.

After the matrix has been thoroughly mixed, a catalyst is added into the matrix to stimulate the curing process. Catalyst levels should be selected so as to generate minimum heat formation and provide short cure times. Thorough mixing is usually accomplished between 5 and 10 minutes. Mixing should not exceed 15 minutes after the catalyst is added, so as to ensure that the matrix does not begin curing prior to its injection into the mold cavity 20.

After the matrix and the catalyst have been sufficiently mixed in the vacuum chamber, the vacuum is released. The matrix is then poured in a smooth stream into the mold cavity 20. Slight vibration may be used to remove any air injected during the pouring of the matrix. The mold cavity 20 is preferably formed from a metal. Alternatively, the mold cavity 20 may be formed from vinyl ester, rubber, fiberglass, silicone, or the like. The pouring is preferably performed at one position along the upper periphery of the outer mold half 21 so as to prevent the formation of air bubbles. The resin matrix is hardened not by air cooling, but by the catalyst. The catalyst will usually begin hardening the matrix between 15 and 30 minutes after its introduction into the matrix. Ideally, the matrix should begin hardening within 10 to 15 minutes after being contacted with the mold cavity 20.

After the molded outer casing 11 has cured, the support bar 23 is detached and removed (along with the circular screw-face attachment 25) from the outer mold half 21. The burial urn 10 can then be removed from the outer mold half 21 and cleaned of any residuals.

Although the present invention has been described in detail with reference to its presently preferred embodiment, it will be understood by those of ordinary skill in the art that various modifications and improvements to the present invention are believed to be apparent to one skilled in the art. Accordingly, no limitation upon the invention is intended, except as set forth in the appended claims.

What is claimed is:

1. A burial urn comprising:

a hollow outer casing, formed from a acrylic or polymeric material and an inert filler, having an opening at one end;

an inner liner of said outer casing, formed from a high-impact plastic material, located inside said outer casing and having a screw-threaded end portion located along said opening of said outer casing, said inner liner having an inside capacity sufficient to receive the entire cremants of a human being; and an inner plastic top having a screw-threaded portion for sealing engagement said end portion of said inner liner and for sealing said inner liner.

2. A burial urn as recited in claim 1, wherein said opening and said aperture are at least 2-inches in diameter.

3. A burial urn as recited in claim 1, where said inner liner has an inside capacity of at least 300 cubic inches.

4. A burial urn as recited in claim 1, wherein said inner liner comprises polyethylene or acrylonitrile-butadiene-styrene.

5. A burial urn as recited in claim 1, wherein said acrylic or polymeric material comprises isothalic neo-pentylglycol modified unsaturated polyester resin including a styrene monomer or a mixture of a styrene monomer and methyl methacrylate.

6. A burial urn as recited in claim 5, wherein said acrylic or polymeric material is promoted to a cure with methyl ethyl ketone peroxide or benzoyl peroxide at room temperature.

7. A burial urn comprising:

a hollow outer casing, formed from an acrylic or polymeric material and an inert filler, having an opening at one end and a recess surrounding said opening;

an inner liner of said outer casing, molded from a high-impact plastic material, located inside said outer casing and having a screw-threaded end portion located along said opening of said outer casing, said inner liner having an inside capacity sufficient to receive the entire cremants of a human being;

an inner plastic top having a screw-threaded portion for sealing engagement said end portion of said inner liner and for sealing said inner liner; and a lid fitted into said recess of said outer casing which encases said inner liner and said inner plastic top.

8. A burial urn as recited in claim 7, wherein said opening and said aperture are at least 2-inches in diameter.

9. A burial urn as recited in claim 7, wherein said inner liner is formed with rounded corners for relieving stress points during manufacture of said outer casing.

10. A burial urn as recited in claim 7, wherein said inner liner comprises polyethylene or acrylonitrile-butadiene-styrene.

11. A burial urn as recited in claim 7, wherein said acrylic or polymeric material comprises isothalic neo-pentylglycol modified unsaturated polyester resin including a styrene monomer or a mixture of a styrene monomer and methyl methacrylate.

12. A burial urn as recited in claim 11, wherein said acrylic or polymeric material is promoted to a cure with methyl ethyl ketone peroxide or benzoyl peroxide at room temperature.

13. A burial urn as recited in claim 1, where said inner liner has an inside capacity of at least 300 cubic inches.

14. A burial urn as recited in claim 7, where said inner liner has an inside capacity of at least 300 cubic inches.

* * * * *